US009801789B2

(12) United States Patent
Weibel

(10) Patent No.: US 9,801,789 B2
(45) Date of Patent: Oct. 31, 2017

(54) DEVICE FOR BRINGING TOGETHER SUBSTANCES, IN PARTICULAR FOR RECONSTITUTION OF INJECTION SOLUTIONS

(71) Applicant: WEIBEL CDS AG, Waldstatt (CH)

(72) Inventor: Ludwig Daniel Weibel, Waldstatt (CH)

(73) Assignee: Weibel CDS AG, Waldstatt (CH)

( * ) Notice: Subject to any disclaimer, the term of this patent is extended or adjusted under 35 U.S.C. 154(b) by 0 days.

(21) Appl. No.: 14/898,784

(22) PCT Filed: Jul. 7, 2014

(86) PCT No.: PCT/EP2014/064441
§ 371 (c)(1),
(2) Date: Dec. 16, 2015

(87) PCT Pub. No.: WO2015/004056
PCT Pub. Date: Jan. 15, 2015

(65) Prior Publication Data
US 2016/0136053 A1 May 19, 2016

(30) Foreign Application Priority Data
Jul. 11, 2013 (EP) ..... 13176031

(51) Int. Cl.
*A61J 1/20* (2006.01)
*B65D 83/00* (2006.01)
(Continued)

(52) U.S. Cl.
CPC ..... *A61J 1/2096* (2013.01); *A61J 1/10* (2013.01); *B65B 3/003* (2013.01); *B65D 83/0077* (2013.01)

(58) Field of Classification Search
CPC ..... B65B 3/003; A61J 1/10; A61J 1/2096
(Continued)

(56) References Cited

U.S. PATENT DOCUMENTS 6,223,944 B1 * 5/2001 Gehl ..... B65D 77/06 222/1
8,292,848 B2 * 10/2012 Kriesel ..... A61M 5/14244 604/132

(Continued)

FOREIGN PATENT DOCUMENTS

| | | | |
|---|---|---|---|
| EP | 2 559 414 | A1 | 2/2013 |
| WO | 2012/133052 | A1 | 10/2012 |
| WO | 2013/003951 | A1 | 1/2013 |

OTHER PUBLICATIONS

International Search Report Corresponding to PCT/EP2014/064441 dated Aug. 22, 2014.

(Continued)

*Primary Examiner* — Timothy L Maust
*Assistant Examiner* — Timothy P Kelly
(74) *Attorney, Agent, or Firm* — Davis & Bujold PLLC; Michael J. Bujold

(57) ABSTRACT

The device (1) has a housing (2), and a flexible bag arranged in the housing and intended to receive a liquid. A dispensing device, in particular an injection syringe (5), is also arranged in the housing, so that it is removable from the housing. A transfer channel (6) serves for direct or indirect transfer of the liquid from the bag into the dispensing device. At least one pressure plate (7) is also provided, which can be pressed against the bag in order to empty the bag. The pressure plate is preferably activated via a spring mechanism (16), which serves as energy accumulator. The device, according to the invention, makes it possible, with a few manoeuvres, to prepare an injection liquid and deliver it to the injection syringe, with the substances being brought together by a largely automated procedure.

15 Claims, 19 Drawing Sheets

(51) Int. Cl.
*A61J 1/10* (2006.01)
*B65B 3/00* (2006.01)

(58) Field of Classification Search
USPC ..... 141/18, 21–27; 604/132; 222/92, 95, 222/106
See application file for complete search history.

(56) References Cited

U.S. PATENT DOCUMENTS

| | | | | |
|---|---|---|---|---|
| 2009/0126825 | A1* | 5/2009 | Eliuk | B65B 3/003 141/1 |
| 2013/0221030 | A1* | 8/2013 | Middleton | B67D 3/00 222/103 |
| 2014/0020790 | A1 | 1/2014 | Yuyama et al. | |
| 2014/0305527 | A1 | 10/2014 | Weibel | |

OTHER PUBLICATIONS

Written Opinion Corresponding to PCT/EP2014/064441 dated Aug. 22, 2014.

* cited by examiner

Fig. 21
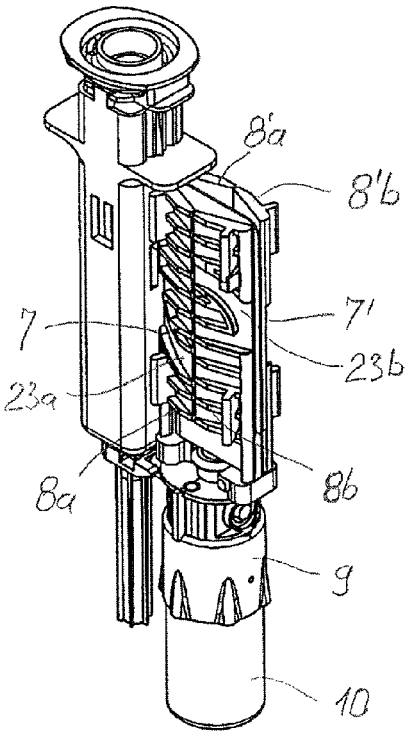
Fig. 22
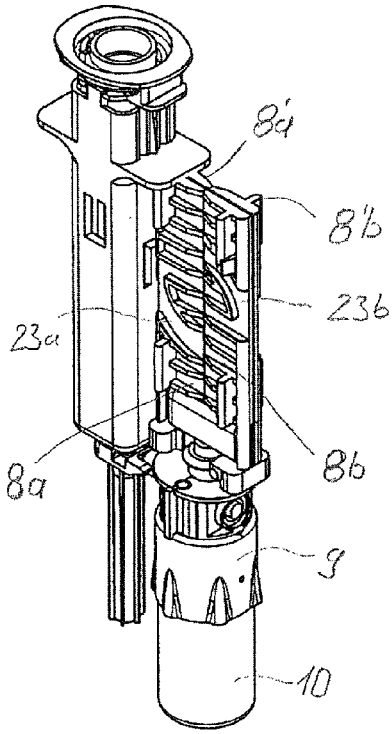
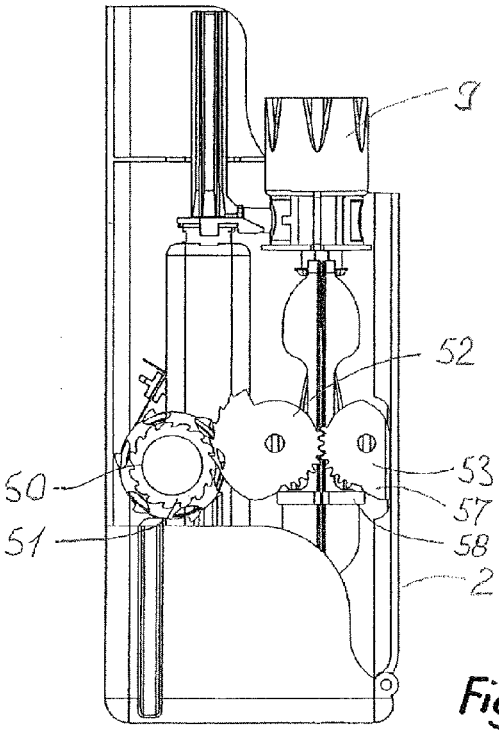
Fig. 23
Fig. 24
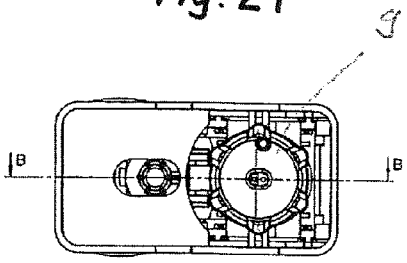

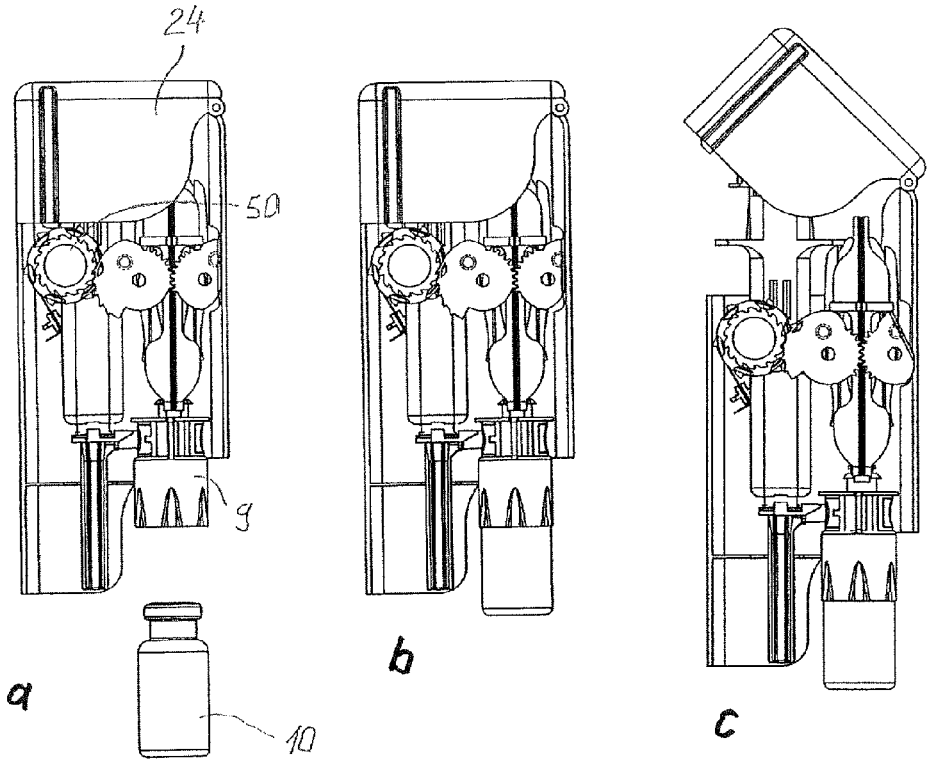
Fig. 27
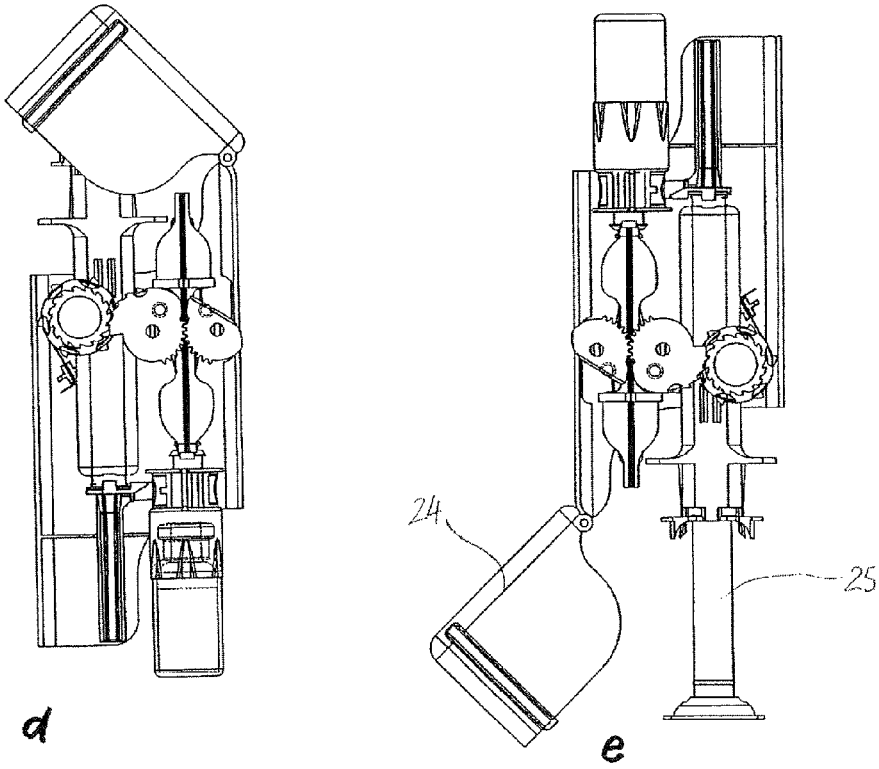

DEVICE FOR BRINGING TOGETHER SUBSTANCES, IN PARTICULAR FOR RECONSTITUTION OF INJECTION SOLUTIONS

The invention relates to a device for bringing together substances, in particular for reconstitution of injection solutions. These types of devices are required, for example, for injection solutions, the constituents of which are not able to be stored in mixed form, such that, for example, a lyophilized medicinal drug is not mixed with a solvent until administration and is then drawn up into a syringe.

Numerous devices are already known and used in the prior art in order to prepare these types of injection solutions. EP 2 559 414 has disclosed an adapter for a transfer device for a fluid. Said adapter serves for the purpose of supplying first of all to a container with a lyophilisate a dilution liquid and then to draw up the injection liquid prepared in this manner into a syringe. WO 2013/003951 describes a reconstitution device with two different chambers which are arranged in one common cylinder and can be connected together by means of piston movements.

A disadvantage of the known systems is that sometimes up to 20 operating steps have to be carried out before the injection solution is drawn up into the syringe and is ready for the injection. In this case, a certain attention and manual dexterity is also necessary, faulty manipulations frequently occurring. Finally, in the case of many systems, different components also have to be stored separately, which increases the overall expenditure.

Consequently, it is an object of invention to create a device of the type mentioned the introduction, by means of which the reconstitution of the substances can be simplified and automated. In this case, handling should take place as simply and safely as possible.

Said object is achieved according to the invention with a device which comprises the features in claim 1. The flexible bag, which is arranged in a housing, serves for receiving a liquid, generally a solvent. A dispensing device, generally an injection syringe, is arranged in the same housing and is removable from said housing. However, other dispensing devices such as, for example, drop counters, spray receptacles or the like would be easily conceivable. As a result of being accommodated in a common housing, the bag and the dispensing device are protected against contamination and damage. A transfer channel for the direct or indirect transfer of the liquid leads from the bag into the dispensing device. The hydraulic pressure for the transfer of the liquid is applied by at least one pressure plate which is pressable against the bag for squeezing out the bag. Said at least one pressure plate is also accommodated in the mentioned housing, such that the device forms a compact unit which is able to be stored and transported in a simple manner.

In a particularly advantageous manner, the device is provided with two pressure plates, between which the bag is arranged. In this way, the bag can be squeezed out in such a manner that it always remains approximately in the same plane, each of the two pressure plates having to carry out a smaller movement than if there were just one single pressure plate.

Further advantages can be achieved if each pressure plate comprises two pivotably interconnected portions which are movable out of an angled rest position into an extended squeezing position. In this way, the pressure plates do not have a plane-parallel effect on the flexible bag, but rather squeezing out is effected from the, outer edge toward the center of the bag. The two portions, in this case, can be connected together, for example by means of a film hinge. The pressure plates can consist of plastics material and can be produced, for example, using an injection molding method. In this case, it is also possible for the pressure plates to be structured on the side remote from the bag and to comprise functional elements such as, for example, reinforcement ribs, cams or the like.

The housing can comprise a connecting piece for the connection of a container containing a second substance, wherein the connecting piece communicates with the transfer channel and/or with the flexible bag by means of a valve device. Said connecting piece can be provided with coupling means for holding a container mouth as well as with a hollow needle for penetrating the closure element on the container. In this way, a container with a freely selectable substance can be connected to the device.

As an alternative to this or in addition to it, however, it is also possible for an additional container, preferably also a flexible bag, which communicates with the transfer channel by means of a valve device, to be arranged in the housing. In this way, it is possible to store the second substance already in the additional container inside the housing. The second substance, in this case, could also be a liquid.

Further advantages can be achieved when a valve device for blocking the fluid connection between the flexible bag and the dispensing device is arranged in the transfer channel, wherein the valve device is movable into the open position as a result of a lifting movement. A valve device which is activatable by means of a lifting movement can be controlled in a particularly simple manner. As an alternative to this, however, other valve functions would also be conceivable such as, for example, a flap valve or a friction tap.

A particularly advantageous function can be achieved when a mechanical energy storage device, in particular a spring mechanism, is arranged as driving means in the housing, by way of which the pressure plate is pressable against the bag. An energy storage device of this type causes the pressure plate to be acted upon with always approximately the same force irrespective of the position, the transfer of the liquid always occurring at the same time. A spring mechanism is particularly advantageous for this purpose because sufficient forces are able to be applied in a risk-free and loss-free manner. Alternative energy storage devices such as, for example, compressed air storage devices or batteries for driving a micromotor would also be conceivable. The pressure plate could also be actuated, in principle, in a magnetic manner.

The lifting movement at the valve device and the pressure plate are preferably activated with the same driving means. As a result of corresponding control means, said movements can be carried out one after another. Obviously, however, it would also be conceivable, for example, for the lifting movement, or even another movement for the valve actuation, to be carried out manually and for just the pressure plate to be activatable by means of the driving means.

In a particularly advantageous manner, a spring mechanism with at least one spiral spring is arranged in the housing. A spring mechanism of this type can be produced in a simple and cost-efficient manner and, depending on the development of the spiral spring, there is sufficient energy available for different functions. Spring mechanisms of this type are also known and used generally in other areas of the technology. The drive axis of the spring mechanism can be connected to a cam disk for converting the rotational movement into at least one linear force component. The torque of the spring mechanism can be converted into a linear force in a relatively simple manner by means of the cam disk. This would obviously also be possible by means of a gear wheel transmission or with another type of transmission.

The at least one pressure plate can be mounted together with the bag in the housing and in particular can be mounted so as to be linearly displaceable relative to the cam disk. A lifting movement is produced in this way, by way of which a valve device is able to be activated. In the event of using a cam disk, said cam disk can interact in such a manner with engagement members on the pressure plate that initially it carries out a linear movement and is then pressed against the bag maintaining the reached end position. This produces a composed movement, by means of which the valve is actuated initially in order then to bring about the transfer of the liquid.

Obviously, the squeezing out of the bag could also be effected using other mechanical means, for example by means of a bar mechanism or by means rollers or pins which are pressable against the pressure plate or even directly by means of a spring which presses directly against the pressure plate.

The housing can comprise a cover or a handle element, the driving means being activatable as a result of opening the cover or as a result of actuating the handle element. In particular the dispensing device, which is removable out of the housing, is protected and held in position by means of the cover. The advantage of activating the driving means by means of the cover movement is that the transfer of the liquid out of the flexible bag is executed automatically without further actuating means having to be activated. Activation of the driving means would obviously also be conceivable by means of a push-button or the like.

A particularly advantageous transfer of the liquid into an injection syringe which is mounted in the housing can be effected as a result of the injection syringe comprising a needle holder which communicates with the transfer channel, wherein the fill opening is closable when the injection syringe is removed out of a syringe holder. When the injection syringe is mounted in the housing in the injection holder, the piston is retracted. The injection solution is drawn up via the fill opening as a result of actuating the piston and when the injection syringe is removed out of the injection holder, the fill opening is automatically closed such that the only way the injection solution can still be dispensed is via the needle. These types of mechanisms are known per se and are, for example, also described in EP 2 559 414.

In principle, it is also conceivable for an injection syringe or another type of dispensing device, which already contains a second substance, to be mounted in the housing. In this way, the reconstitution of the liquid to be dispensed would be directly effected in the dispensing device itself.

The flexible bag is arranged in an advantageous manner between two pressure plates, said pressure plates being activable either via a common driving means or via individual driving means which are assigned to the pressure plates. For example, each pressure plate can have a spring mechanism with an own cam disk associated therewith. Said two cam disks can also comprise cam portions which are realized differently in such a manner that the pressure plates are pressable against the bag in a non-symmetrical movement. As a result, it can be ensured that the bag is squeezed out in such a manner that no liquid pockets remain behind.

An advantageous development of the mechanical energy storage means device can be achieved when at least one spring clamp is mounted in the housing in such a manner in a rest position which is tensioned against the spring force that, as a result of a lifting movement, it is movable out of the rest position into a pressing position in which the pressure plate is pressable against the bag. A spring clamp of this type can be produced in a simple manner and mounted in the rest position. In order to exert a symmetrical pressing force onto the pressure plate, two spring clamps, for example, can cooperate at the side on each side of the pressure plate.

Further advantages can be achieved when the pressure plate is displaceable in the housing as a result of opening the cover or as a result of actuating the handle element and when by means of said displacement the spring clamp is movable into the pressing position and when, at the same time, a valve device which is arranged in the transfer channel for blocking the fluid connection between the flexible bag and the dispensing device, is movable into the open position. Obviously the releasing of the spring clamp is effected by a movement of the pressure plate in the housing, said lifting movement not being effected by the mechanical energy storage device but in a manual manner. As no particularly high forces have to be exerted, said solution results in a reduction in movable components and consequently in a simplification.

If the housing comprises a handle element, said handle element can be realized as a lever which is pivotable about a rotary joint and, in a closed position, secures the dispensing device in the housing and in an open position releases the dispensing device. In addition, the cover or the handle element can be operatively connected to the pressure plate in such a manner by means of a lever gear unit that a rotational movement at the cover or at the handle element is transferable into a linear movement at the pressure plate.

The flexible bag is preferably arranged between two pressure plates which are pressable against one another as a result of being guided by complementary guide elements.

Further advantages and individual features of the invention are produced from the subsequent description of exemplary embodiments and from the drawings, in which.

Figure 1:
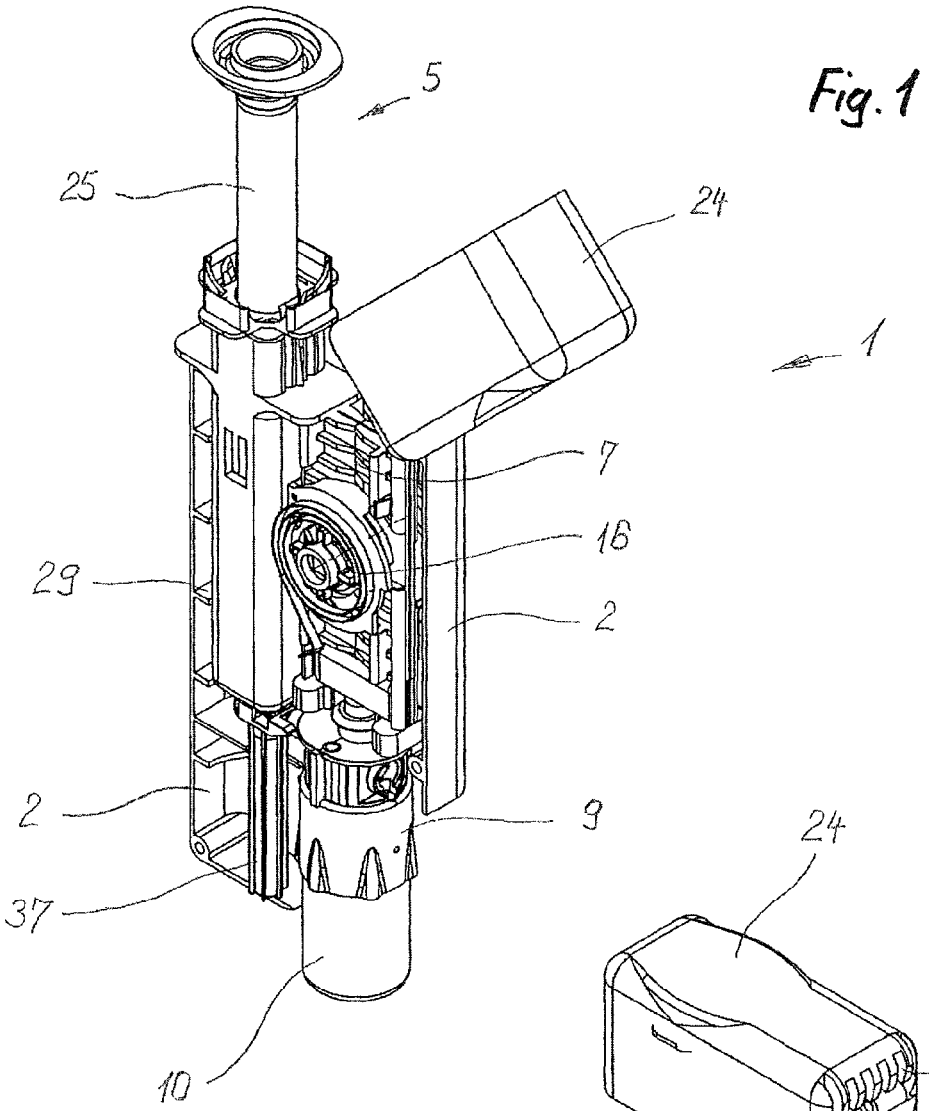
FIG. 1 shows a perspective representation of a device with the housing partially removed and the cover open.
Figure 25:
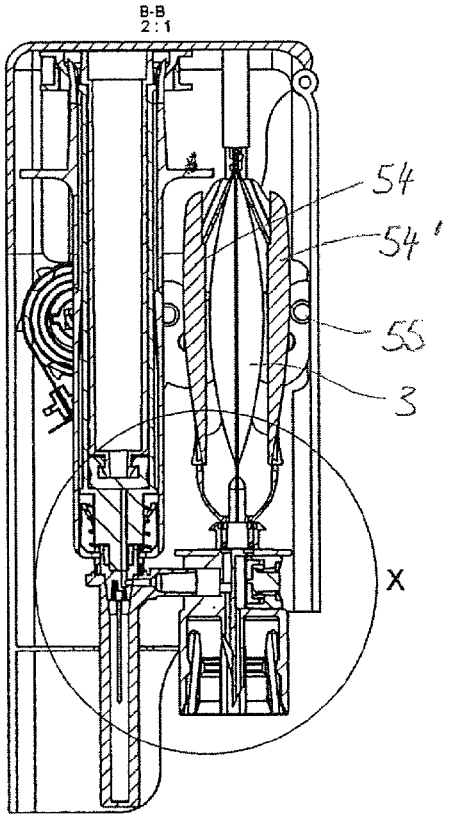
Figure 26:
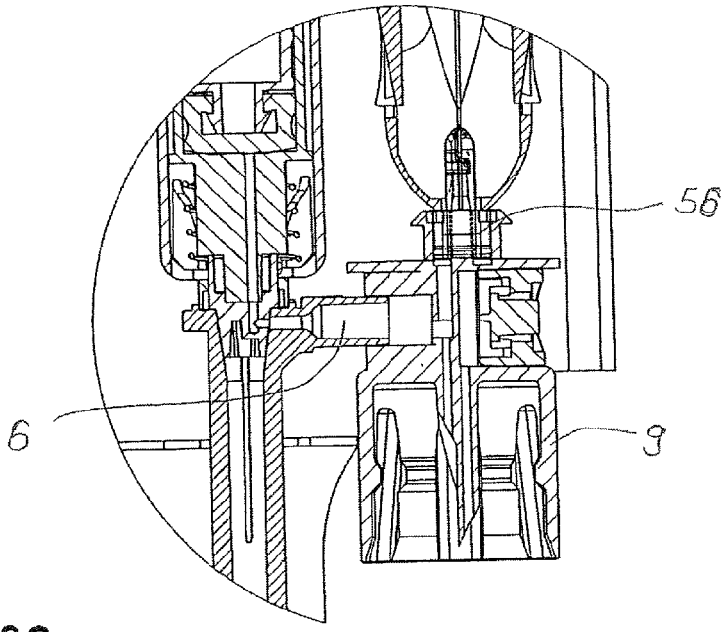
Figure 28:
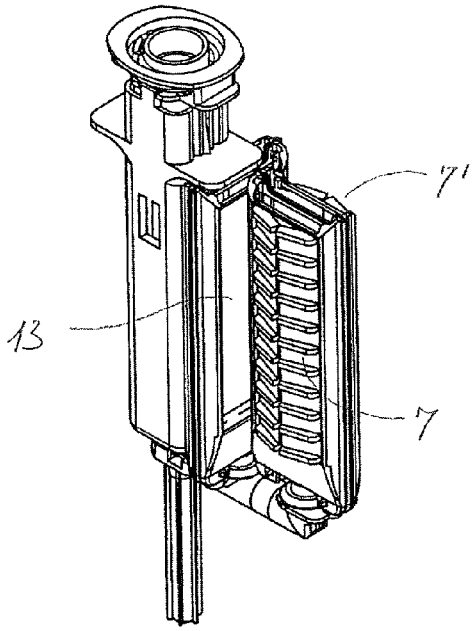
Figure 29:
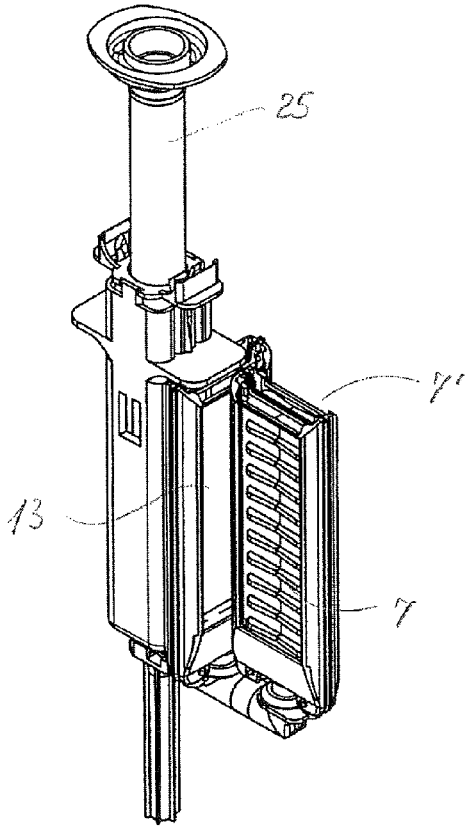
Figure 30:
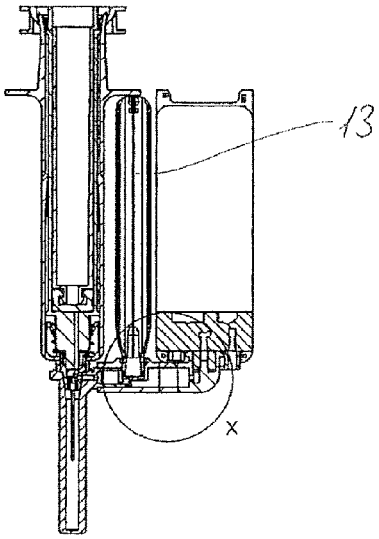
Figure 31:
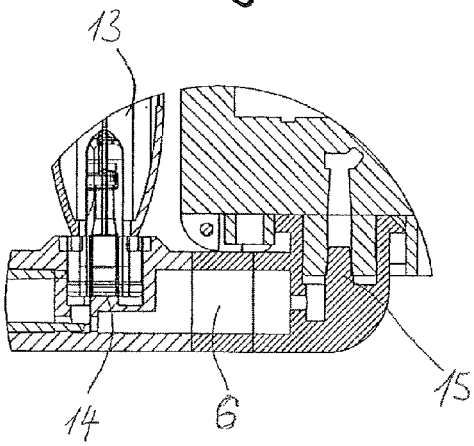
Figure 32:
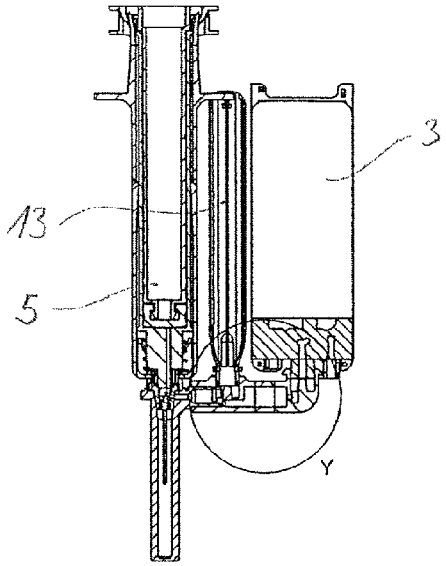
Figure 33:
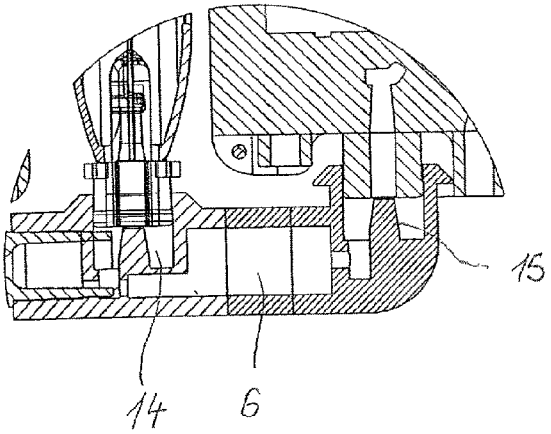
Figure 34:
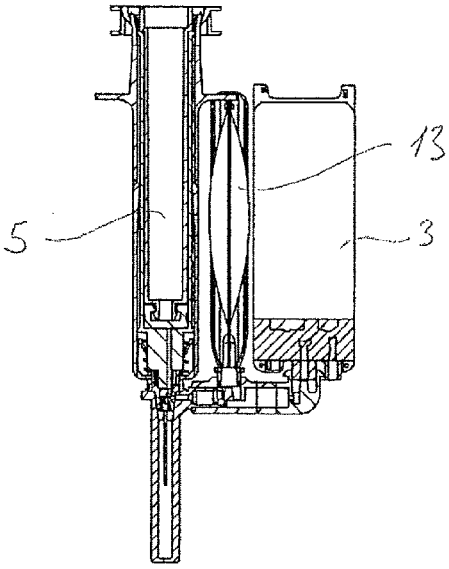
Figure 35:
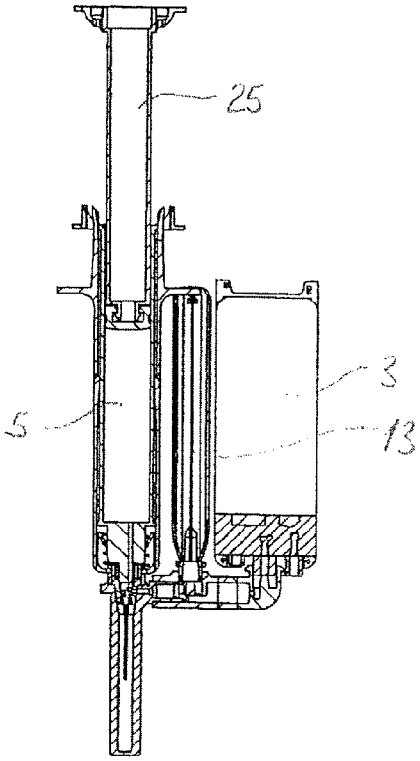
Figure 36:
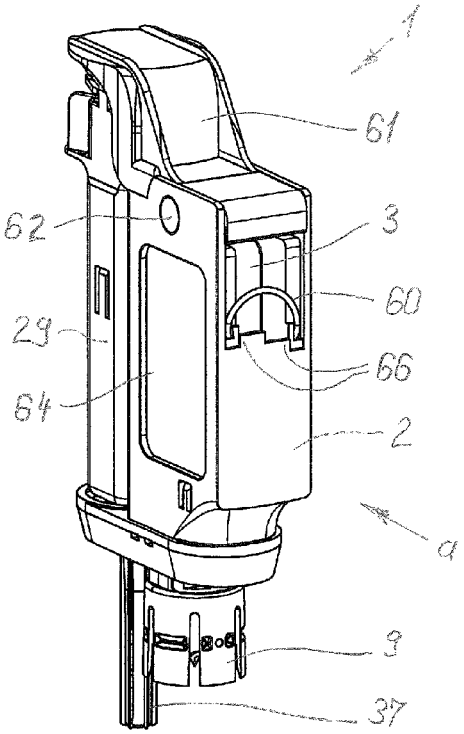
Figure 37:
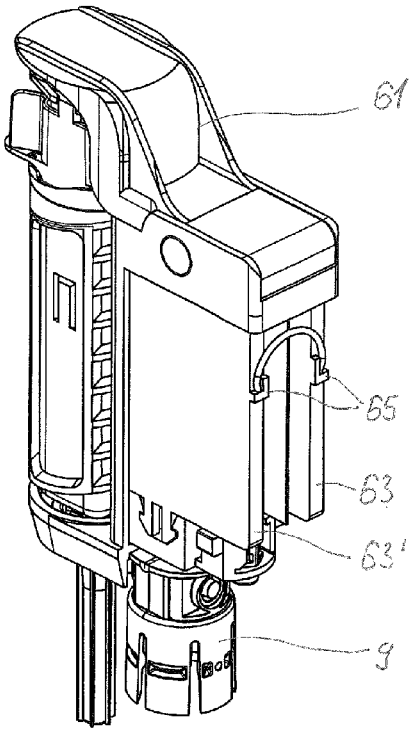
Figure 38:
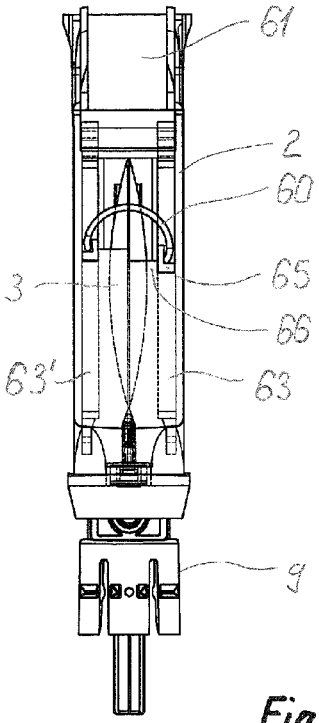
Figure 39:
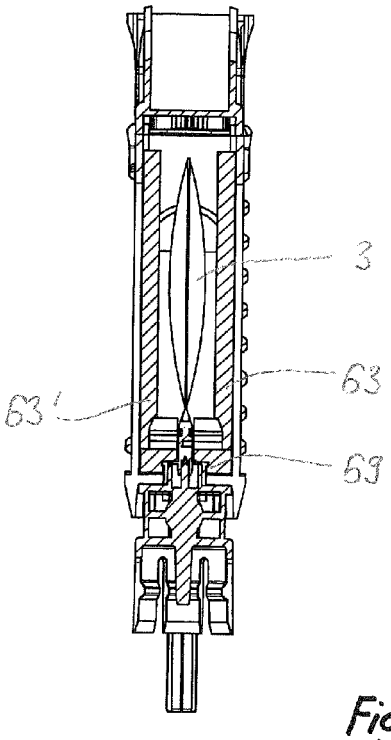
Figure 40:
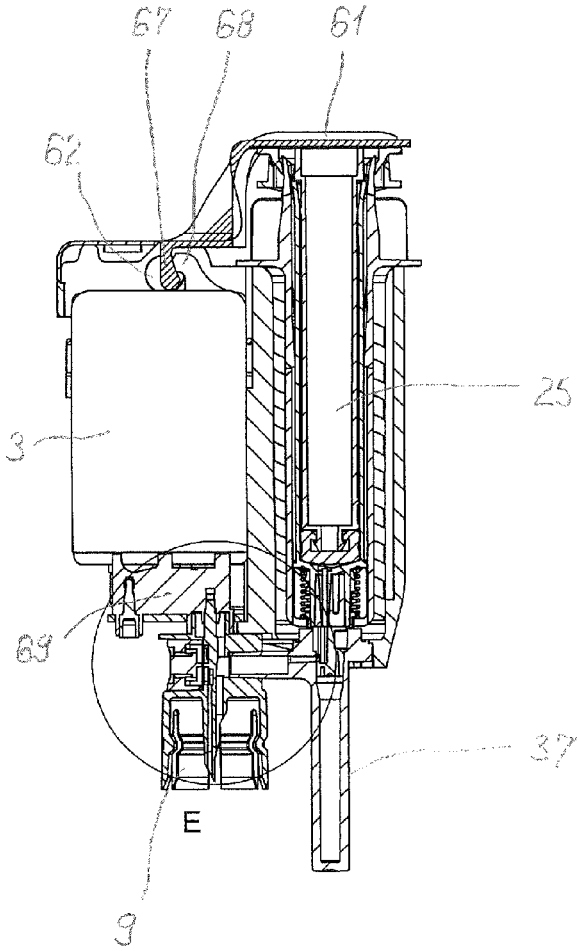
Figure 41:
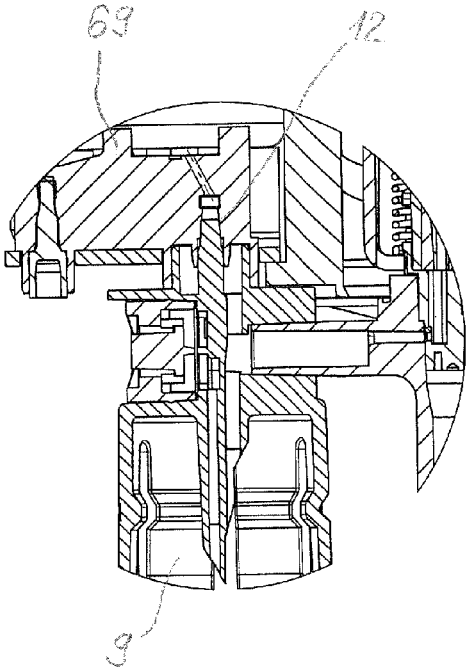
Figure 42:
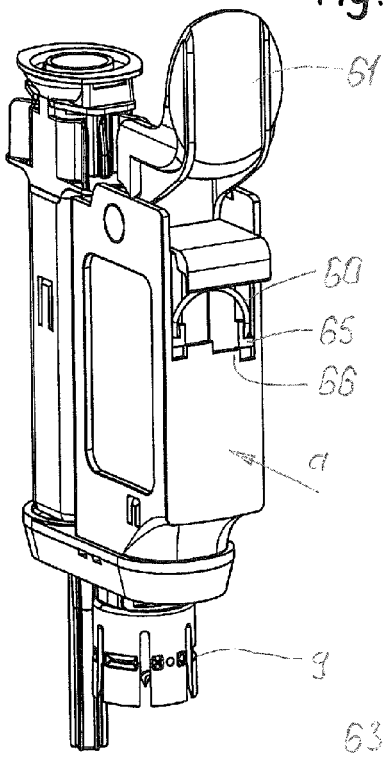
Figure 43:
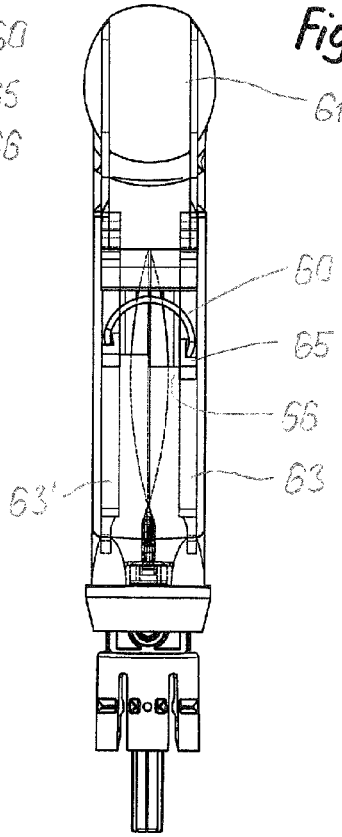
Figure 45:
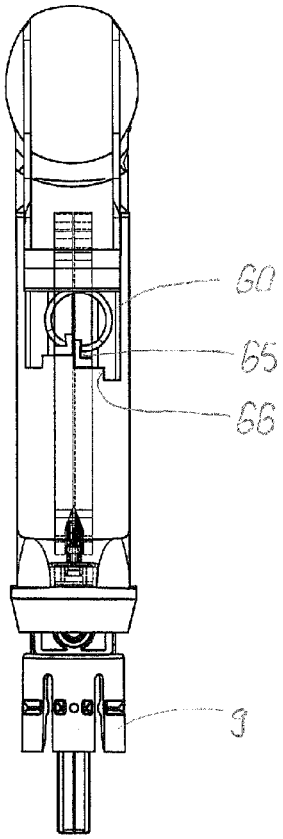
Figure 44:
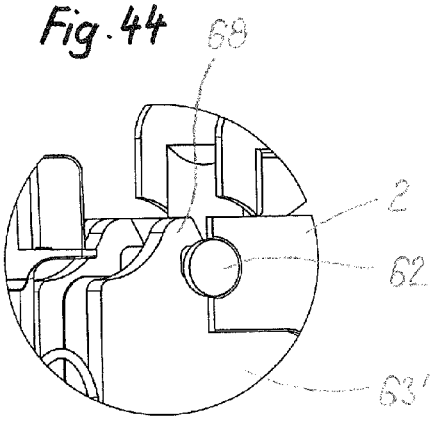
Figure 46:
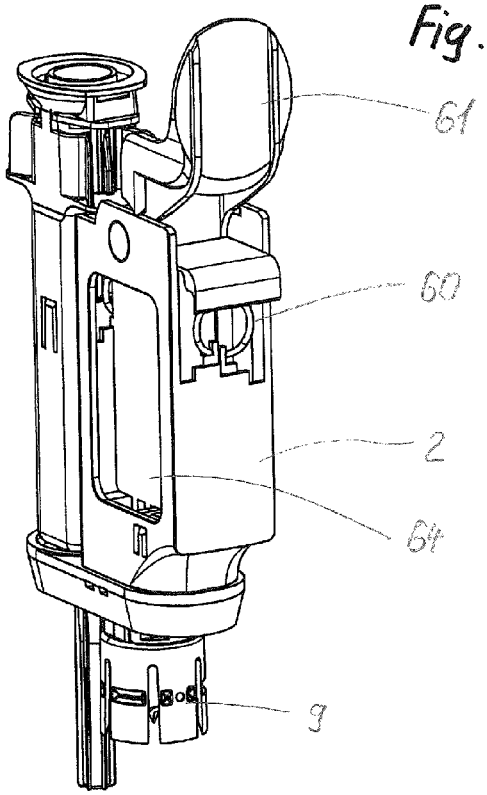
Figure 48:
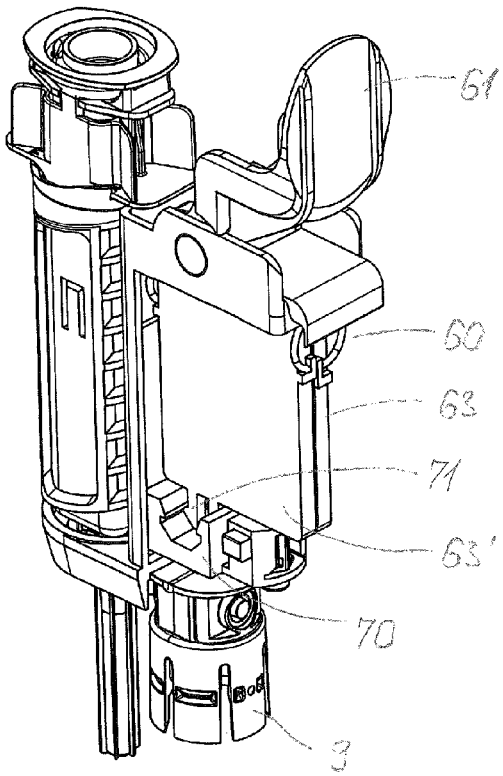
Figure 47:
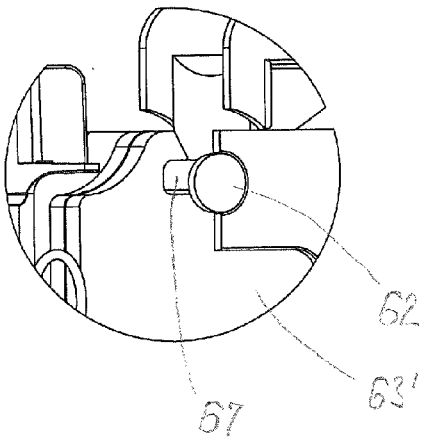
Figure 49:
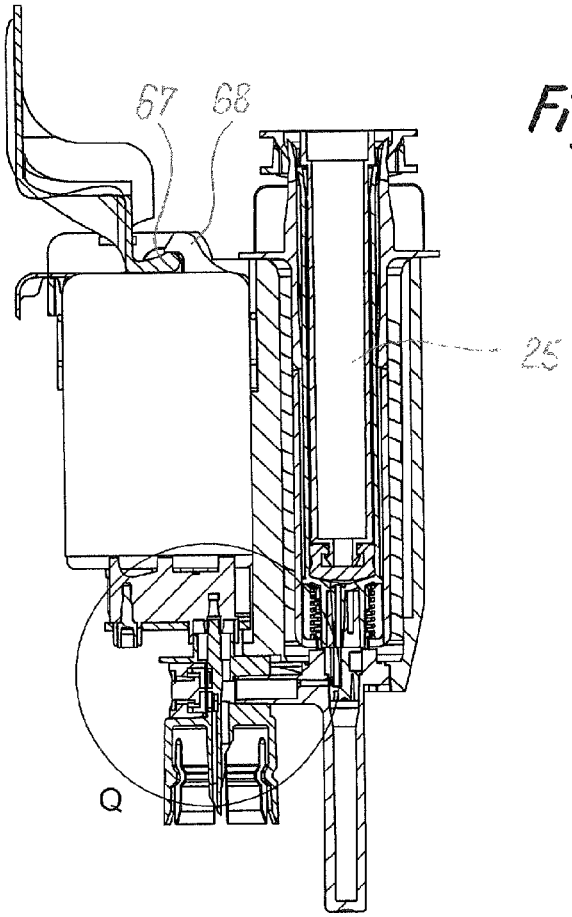
Figure 50:
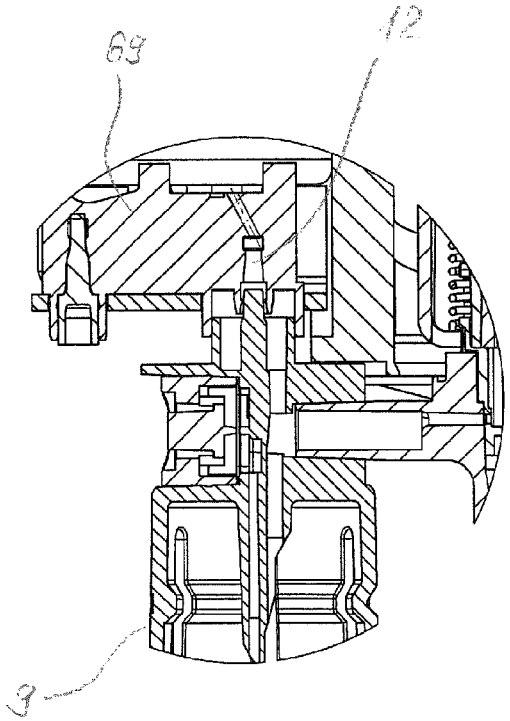

FIG. 20*a*-20*e* show the representation of the function of a device in five different steps;

FIG. 21 shows a perspective representation of the device according to FIG. 1 with the housing removed and the driving means removed;

FIG. 22 shows the device according to FIG. 21 with the pressure plates closed;

FIG. 23 shows an alternative exemplary embodiment of a device with a gear wheel transmission;

FIG. 24 shows a top view of the device according to FIG. 23:

FIG. 25 shows a cross section through the device according to FIG. 23;

FIG. 26 shows the detail x according to FIG. 25;

FIG. 27*a*-27*e*: show the function of the device according to FIG. 23 in five different steps;

FIG. 28 shows a further exemplary embodiment of the device with a second container inside the housing;

FIG. 29 shows the device according to FIG. 28 after the flexible bag has been squeezed out;

FIG. 30 shows a cross section through the device according to FIG. 28;

FIG. 31 shows the detail x according to FIG. 30;

FIG. 32 shows the device according to FIG. 30 after the valve device has been opened;

FIG. 33 shows the detail y according to FIG. 32;

FIG. 34 shows the device according to FIG. 32 after filling the second bag;

FIG. 35 shows the device according to FIG. 34 after drawing the liquid into the syringe;

FIG. 36 shows a perspective representation of an alternative exemplary embodiment of a device prior to opening the handle element;

FIG. 37 shows the device according to FIG. 36, but with the housing partially cut open;

FIG. 38 shows a view onto the narrow side of the device according to FIG. 36 in the arrow direction a;

FIG. 39 shows a longitudinal section through the device according to FIG. 36;

FIG. 40 shows a cross section through the device according to FIG. 36 in the plane of the flexible bag;

FIG. 41 shows the detail E according to FIG. 40;

FIG. 42 shows the device according to FIG. 36 after the handle element has been pivoted up, but briefly prior to the pressure plates being pressed together;

FIG. 43 shows a view of the device according to FIG. 42 from arrow direction a;

FIG. 44 shows a perspective representation of a detail of the pressure plate suspension prior to being pressed together;

FIG. 45 shows a top view of the device according to FIG. 42 after the pressure plates have been pressed together;

FIG. 46 shows a perspective representation of the device according to FIG. 42 after the pressure plates have been pressed together;

FIG. 47 shows a perspective representation of a detail of the pressure plate suspension after being pressed together;

FIG. 48 shows the device according to FIG. 46, but with the housing partially cut away;

FIG. 49 shows a cross section through the device according to FIG. 46 in the plane of the flexible bag and FIG. 50 shows the detail Q according to FIG. 49.

Figure 2:
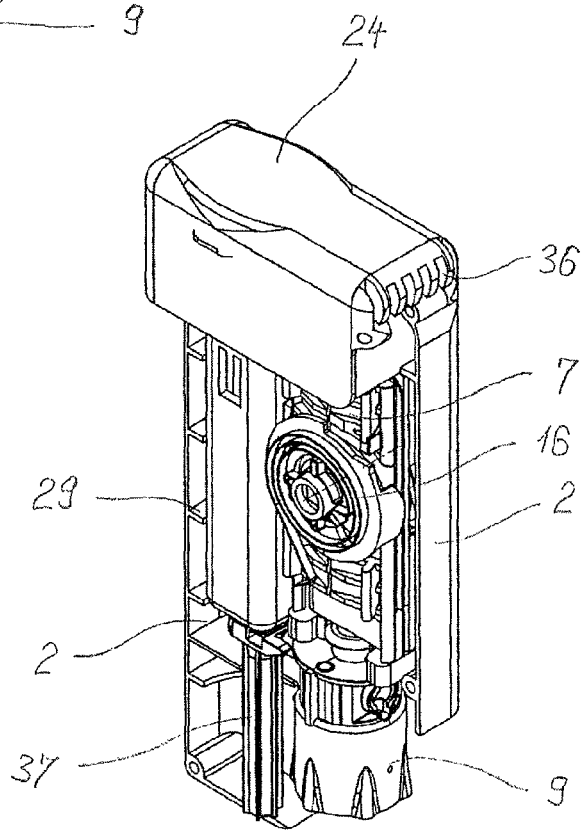
FIG. 2 shows the device according to FIG. 1 prior to opening the cover.

According to FIGS. 1 and 2, a device designated by the reference 1 essentially consists of a housing 2, with a cover 24. Said cover is mounted on the housing so as to be pivotable at a cover joint 36. A syringe holder 29, which receives an injection syringe, designated by the reference 5, in a play-free manner, is realized inside the housing. Two congruent pressure plates, of which only the one pressure plate 7 is visible, are arranged parallel next to the injection holder. A spring mechanism 16, the function of which will be described in more detail below, is mounted fixedly in the housing by means of said pressure plate. A connecting piece 9, into which a container 10 is able to be inserted, projects out of the housing 2 below the two pressure plates. The syringe 5 has a piston 25 which is, however, retracted in the initial position according to FIG. 2. The needle of the injection syringe, which is not visible here, rests in a casing 37 which extends approximately parallel to the connecting piece 9.

Figure 3:
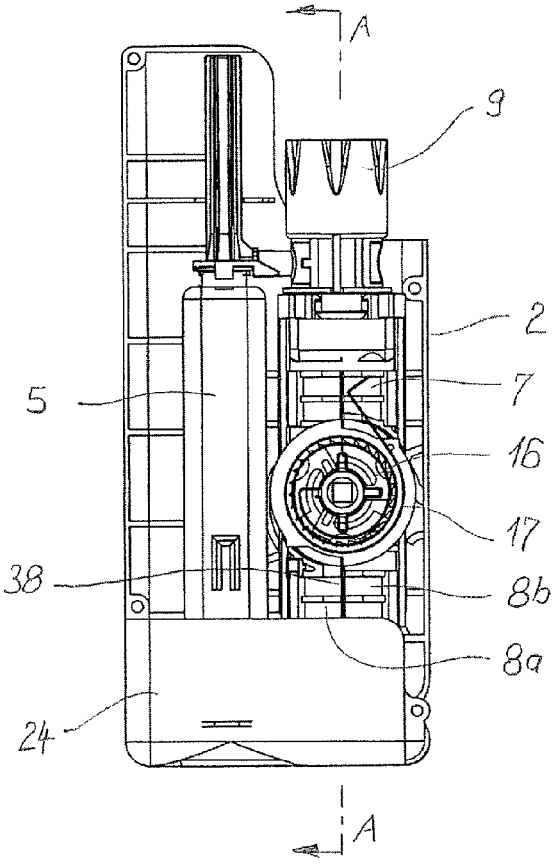
FIG. 3 shows a side view of the device according to FIG. 1.
Figure 4:
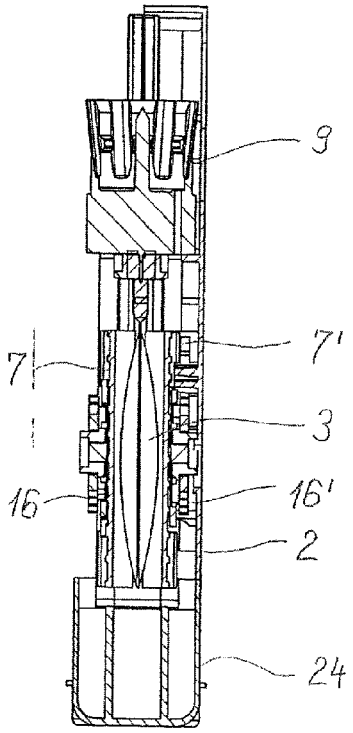
FIG. 4 shows a section through the plane A-A according to FIG. 3.
Figure 5:
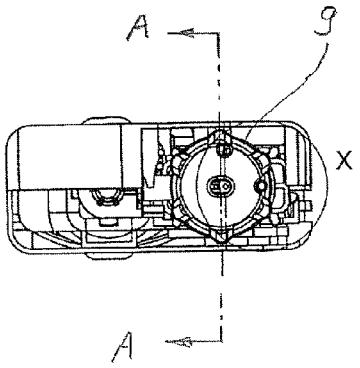
FIG. 5 shows a top view of the device according to FIG. 3.
Figure 6:
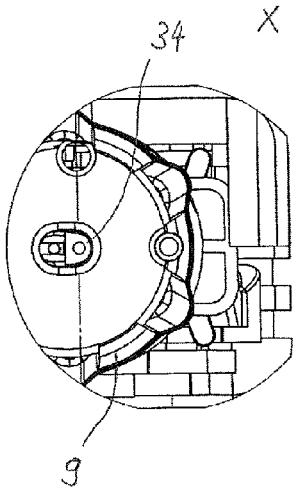
FIG. 6 shows the detail x according to FIG. 5.

FIGS. 3 to 6 show further structural details, according to FIGS. 3 and 4 the device being rotated in such a manner that the cover 24 is located below and the connecting piece 9 above. A flexible bag 3, in which a liquid, for example, a solvent, is filled, is visible between the two pressure plates 7, 7' in FIG. 4. The two pressure plates, in this case, are located in an initial position prior to the squeezing out of the bag 3. As can be seen from FIG. 3, each of the two pressure plates consists of two separate portions 8*a*, 8*b* which are connected together in an articulated manner along a film hinge 38. Each pressure plate 7 and 7' has associated therewith an own spring mechanism 17, each spring mechanism comprising a spiral spring 17. In FIG. 6 a spike 34, by way of which a closure element of the container 10 is able to be pierced, is also visible in the center of the connecting piece.

Figure 7:
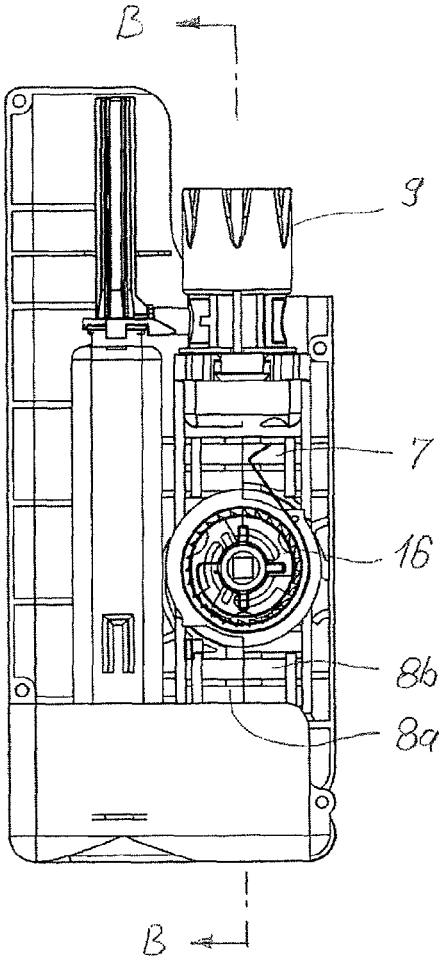
FIG. 7 shows a side view corresponding to FIG. 3 after the bag has been squeezed out.
Figure 8:
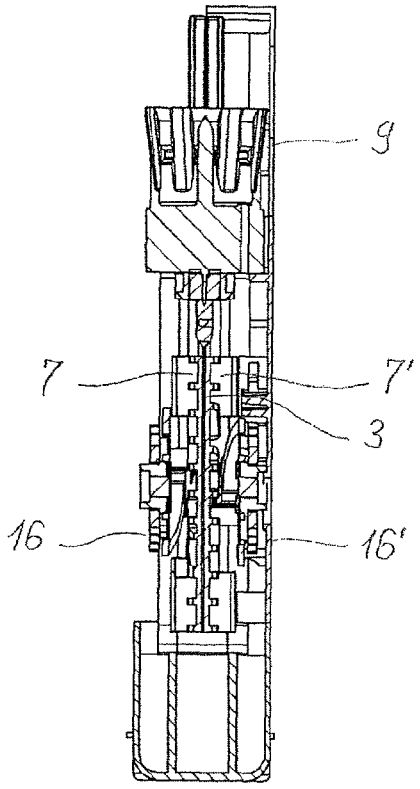
FIG. 8 shows a section through the plane B-B according to FIG. 4 after the bag has been squeezed out.
Figure 9:
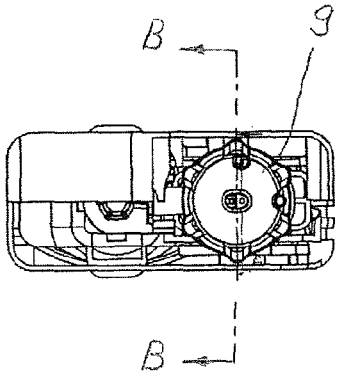
FIG. 9 shows a top view of the device according to FIG. 7.

FIGS. 7 and 8 show the device corresponding to FIGS. 3 and 4, but after the bag 3 has been squeezed out. Said bag now lies flatly between the two pressure plates 7 and 7' which are moved together in a plane-parallel manner under the effect of the two spring mechanisms 16 and 16'. The originally slightly angled plate portions 8*a*, 8*b* are now extended in a flat manner.

Figure 10:
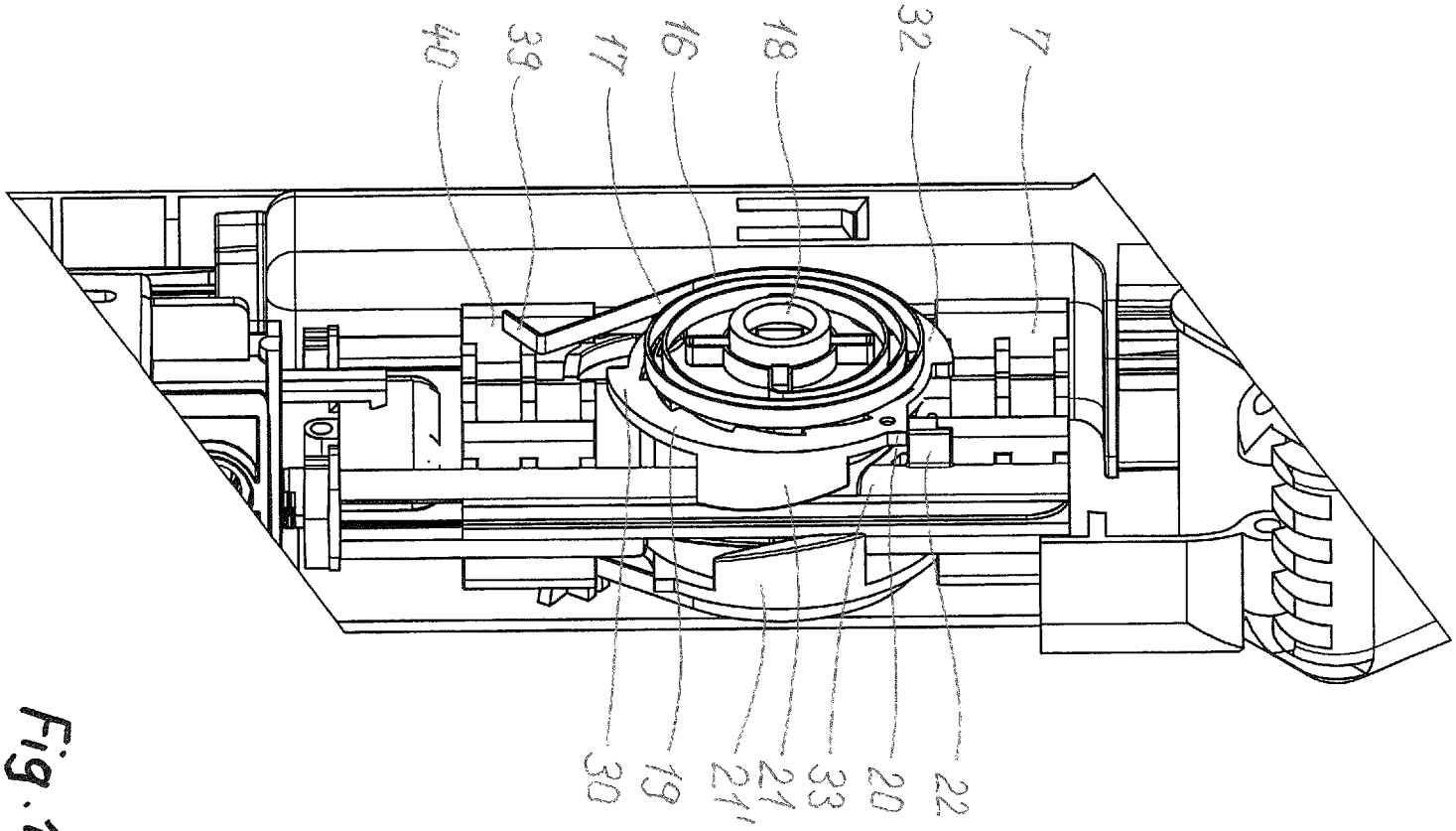
FIG. 10 shows a perspective representation of a spring mechanism prior to activation.
Figure 11:
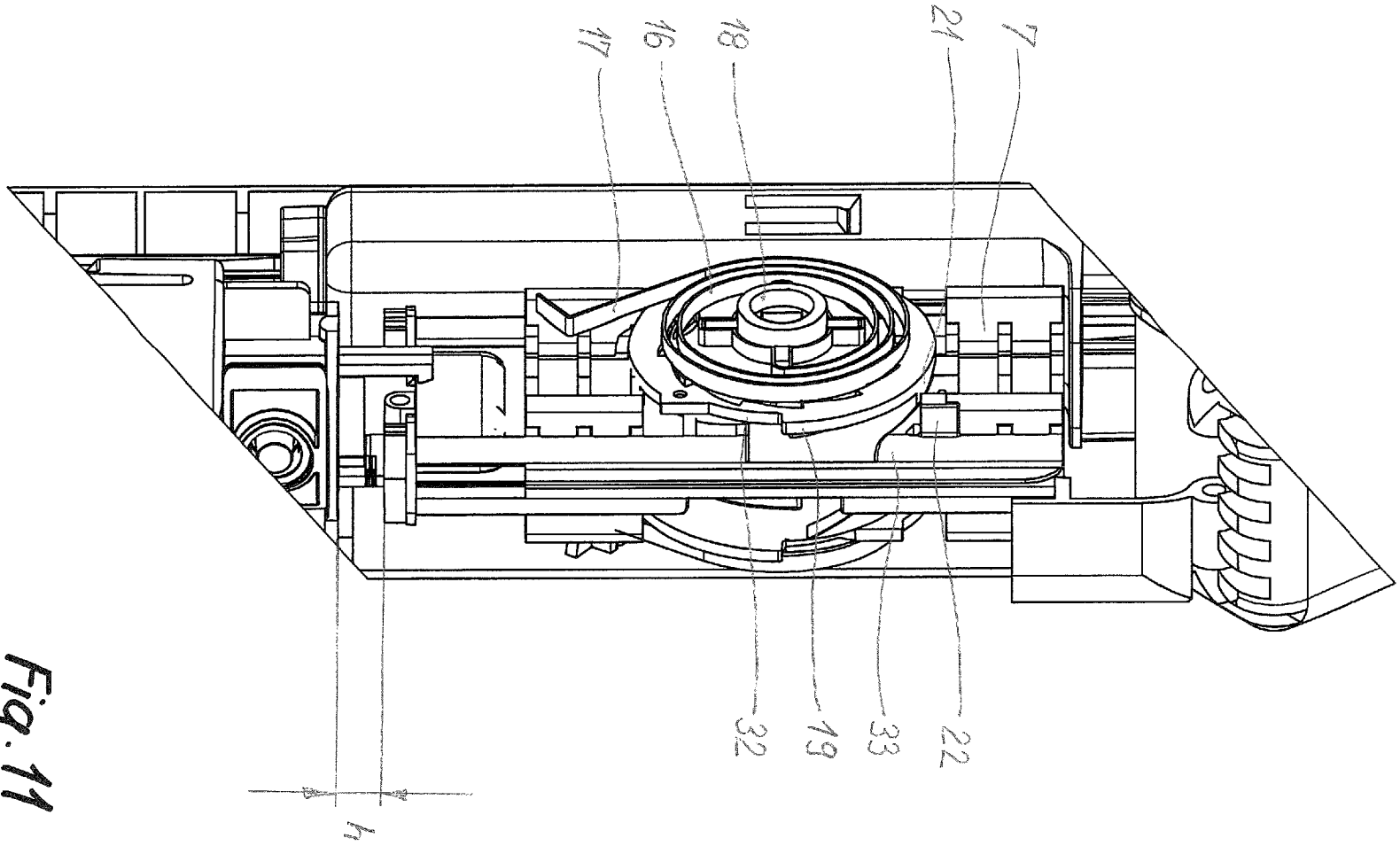
FIG. 11 shows the spring mechanism according to FIG. 10 after activation.
Figure 12:
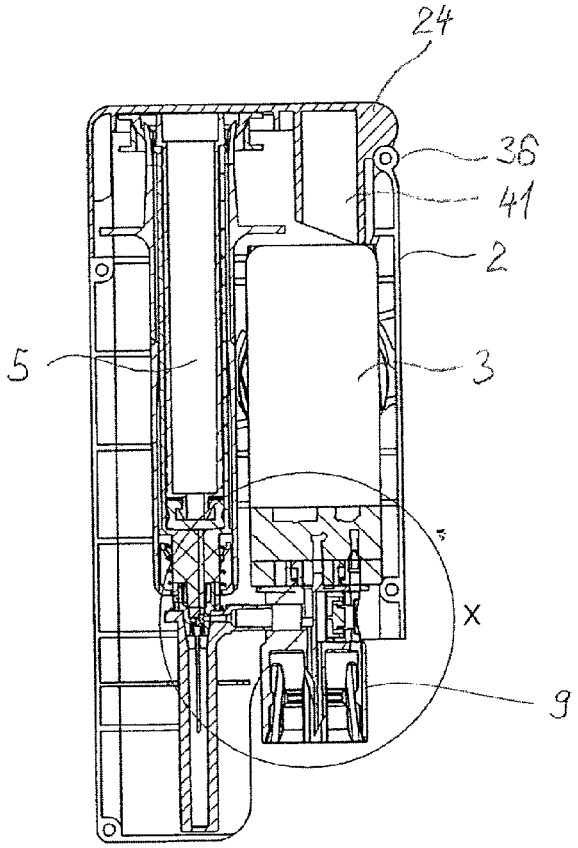
FIG. 12 shows a cross section through the device according to FIG. 1 in the plane of the flexible bag.
Figure 13:
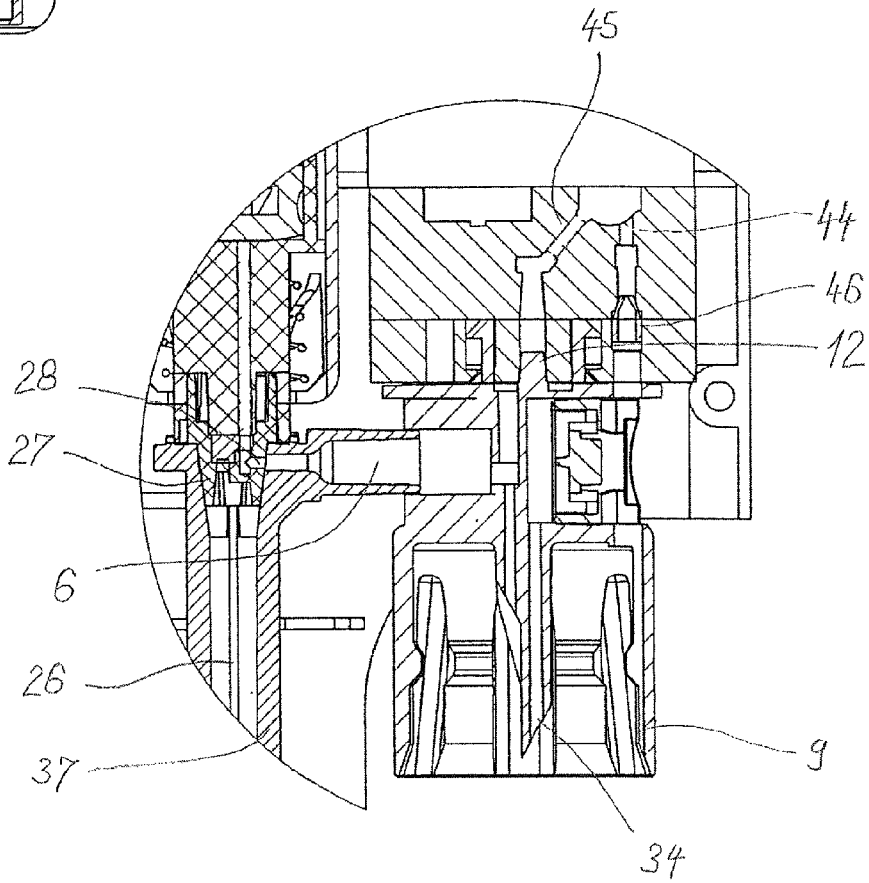
FIG. 13 shows the detail x according to FIG. 12.

The function of the spring mechanism and the control of the pressure plates are described more precisely by way of FIGS. 10 and 11. In several windings the spiral spring 17 of one spring mechanism 16 surrounds a drive axis 18 which, in the present case, is realized as a hollow boss and which is mounted in the side wall of the housing. The free end 39 of the spiral spring is supported at the side on a spring stop 40. The spring mechanism can be tensioned from the outside such that the spiral spring exerts a torque on the drive axis 18. A ratchet assembly 32 ensures that a cam disk 19 is only rotatable in the drive direction, whilst when the spring mechanism is being tensioned it is prevented from turning at the same time by a stop 30. The cam disk 19 also has a pressing wedge segment 21, which is curved in the circumferential direction, as well as a lifting cam 20 which abuts against a lifting stop 22 of the pressure plate 7. The pressure plate additionally has a support shoulder 33 with a curvature which corresponds to the pressing wedge segment 21.

A similar spring mechanism, which also has associated therewith a pressing wedge segment 21', is arranged on the symmetrically rear pressure plate. Said pressing wedge segment, however, has a somewhat flatter wedge inclination such that the two pressure plates are acted upon with forces in a non-symmetrical manner.

The two pressure plates with the flexible bag arranged between them are displaceable in a linear manner relative to the two spring mechanisms, it being possible for them to cover a lift of, for example approximately 2-3 mm.

FIG. 11 shows the situation once the spring mechanism has been activated and consequently once the bag has been squeezed out. The lifting cam 20 (FIG. 10) has displaced the lifting stop 22 upward within the course of the rotational movement of the cam disk 19, as a result of which the entire unit consisting of the two pressure plates 7, 7' and the flexible bag has covered a lifting movement. Once the lifting movement has been completed, the pressing wedge segment 21 engages under the support shoulder 33 such that it is no longer possible to reverse the lifting movement. The ratchet assembly 32 rotates the cam disk 19 further when the spiral spring 17 is released, the pressing wedge segment 21 exerting a pressing force onto the pressure plate 7. Precisely the same operation also occurs on the oppositely situated side. The flexible bag with the transfer channel is short-circuited by means of the lift h which is covered by the linear displacement of the pressing plates.

The valve functions and the fluid connections are shown in FIGS. 12 to 15. According to FIGS. 12 and 13, the device is situated in the initial position in which the bag 3 is blocked with respect to a fluid channel 6 by means of the valve device 12. Said blocking relates to both the connection to the spike 34 on the connecting piece 9 and to a fill opening 28 on a needle holder 27 of the injection syringe 5. The injection needle 26 is held by the needle holder 27. It can also be seen from FIG. 12 that a hold-down element 41, by way of which the pressure plate arrangement is held with the bag 3 in the initial position, is arranged on the cover 24.

The filling of the liquid into the flexible bag 3 is effected in the completely mounted state via a filling channel 44. Said filling channel is then permanently closed by means of a plug 46. The connection between the flexible bag 3 and the valve device 12 is effected via a dispensing channel 45.

Figure 14:
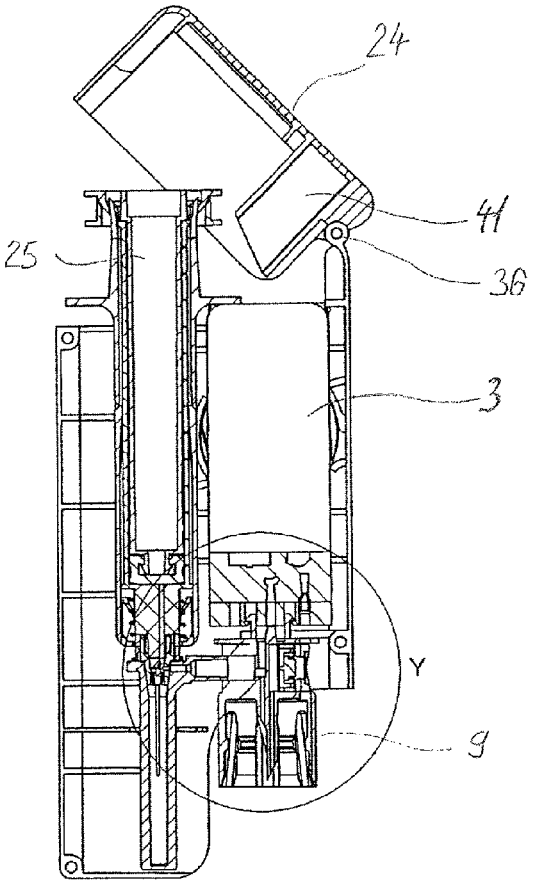
FIG. 14 shows the device according to FIG. 12 after the cover has beer, opened.
Figure 15:
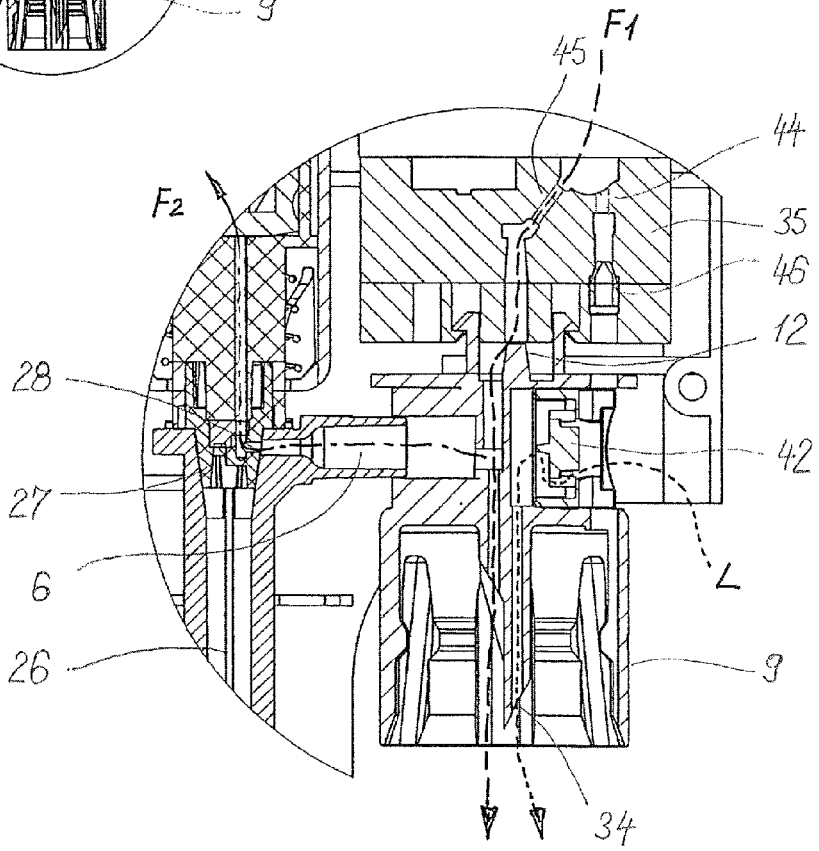
FIG. 15 shows the detail y according to FIG. 14.

FIGS. 14 and 15 show the state once the cover has been opened, a container not being shown in the connecting piece 9 for reasons of better clarity. Once the pressure plate arrangement has been released by the hold-down element 41, the spring mechanism relaxes and said arrangement covers the lifting movement h (FIG. 11). In this case, the valve device 12 is opened and the pressure plates compress the flexible bag 3, the contents of which empty into the container connected to the connecting piece 9 such that the injection liquid is prepared. The fluid flow through the dispensing channel 45 out of the flexible bag through the open valve device 12 and through the connecting piece 9 into the connected container is shown by the broken line F1. The transfer channel 6 and the fill opening 28 are opened during said operation such that the liquid is also able to spread toward the injection syringe insofar as the piston 25 and the air compressed thereby allows this.

After said operation, the piston 25 of the syringe can be pulled out such that the contents of the container are sucked into the injection syringe via the transfer channel 6 and the fill opening 28. A venting opening 42 ensures that no vacuum builds up in the container. As a result of removing the injection syringe out of the syringe holder 29, a rotational movement is effected in the region of the needle holder 27, as a result of which the fill opening 28 is blocked from the outside atmosphere and the contents of the syringe can be emptied by means of the needle 26. The fluid flow when the liquid is drawn from the container into the injection syringe is shown by the dot-dash line F2. The dotted line L indicates the air flow via the venting opening 42. Said venting opening consists of a filter which does allow air through but not liquid.

Figure 16:
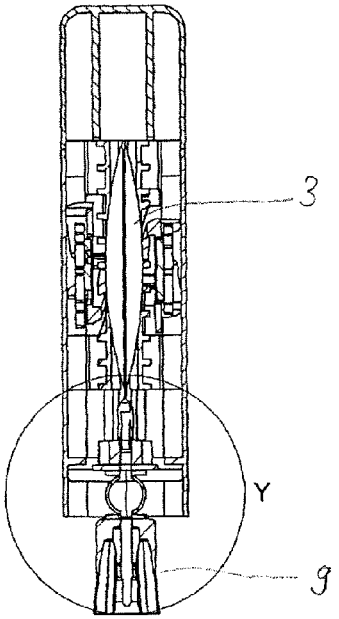
FIG. 16 shows a longitudinal section through a device through the flexible bag.
Figure 17:
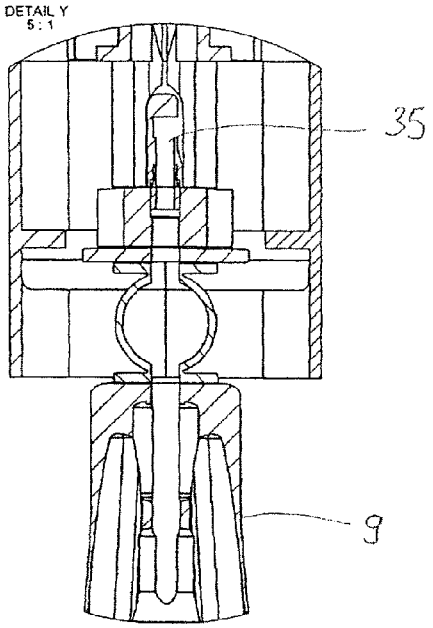
FIG. 17 shows the detail y according to FIG. 16.

FIGS. 16 and 17 show an alternative sectional representation of the connection between the bag 3 and the connecting piece 9, the position 35 showing the bag connection. As the section plane is not located in the center axis of the connecting piece 9, said connection piece is only shown as a part segment.

Figure 18:
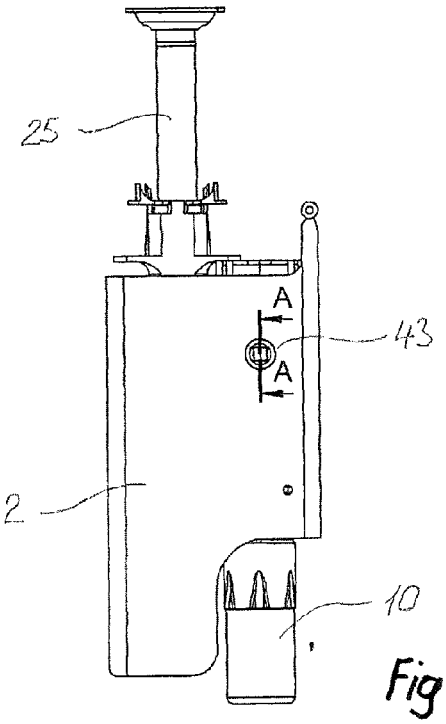
FIG. 18 shows a side view of a closed housing with the injection piston extended.
Figure 19:
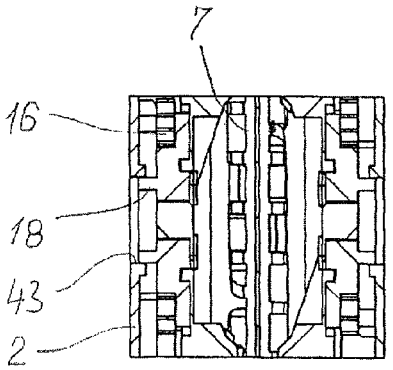
FIG. 19 shows an enlarged cross section through the plane A-A according to FIG. 18.

FIG. 18 shows the outside view of a device (without cover) with the container 10 inserted and the piston 25 of the injection syringe extended. The side housing walls comprise a bearing opening 43 in which the hollow drive axis 18 of the spring mechanism 16 is mounted. Said bearing arrangement is shown in FIG. 19. The spring mechanism is tensioned through the opening 43 once the device has been assembled and once the cover has been closed.

According to FIG. 20, the preparation of an injection solution occurs as follows:

According to a, a device 1 according to the invention and a closed container 10 with a lyophilisate 11 are provided. The container 10 is pressed into the connecting piece 9 such that the centrally arranged spike penetrates the closure of the container and the container is held fixedly in the device (representation b). According to c, the cover 24 can now be opened, the squeezing out operation described previously occurring. Once the bag has been completely squeezed out according to d, all the liquid 4 is situated in the container 10 and the lyophilisate has dissolved in the liquid. Now, according to e, the injection solution can be transferred out of the container 10 into the injection syringe by drawing out the piston 25, in any arbitrary position, preferably, however, in an overhead position. The injection syringe is then removed out of the housing 2, it being possible to put the empty syringe back into the housing again after the application for reasons of safety. Afterwards, the entire unit can be disposed.

By way of illustration, FIGS. 21 and 22 once again show the positions of the pressure plate portions 8*a* and 8*b* and 8*a*' and 8*b*' prior to the squeezing out (FIG. 21) and after the squeezing out (FIG. 22). The pressing tracks 23*a*, 23*b*, against which the pressing wedge segments of the cam disk press within the course of the rotational movement, can also be seen well here. The outside surfaces of the pressing place portions are additionally provided with reinforcement ribs.

An alternative exemplary embodiment, where the squeezing mechanism differs from that of the previously named exemplary embodiment, is shown in FIGS. 23 to 26. One common spring mechanism 50 with a ratchet assembly 51 serves here for activating the two pressure plates. A first gear wheel segment 52, which meshes which a second gear wheel segment 53, is driven by means of the ratchet assembly for this purpose. The rotational axes of the two gear wheel segments are located on both sides of the pressure plate arrangement. The gear wheel segments are moved in opposite directions and they are provided with pressing elements 55 which are pressable against the pressure plates 54 (FIG. 25). The pressure plates 54 and 54' are produced, for example, as injection molding parts and are connected together integrally by means of material films. The movement of the two gear wheel segments 52 and 53 working in opposite directions obviously cause the bag 3 to be squeezed out. As can be seen from FIG. 26, the liquid is also transferred here initially into the container docked onto the connecting piece 9 and then to the injection syringe by means via the transfer channel 6. The lifting movement of the pressing plate arrangement and consequently the opening of the valve device 56 (FIG. 26) is controlled by the two gear wheel segments 52 and 53. Said gear wheel segments have control cams 57 which act on a stop 58 and thus bring about a linear displacement.

Figure 20:
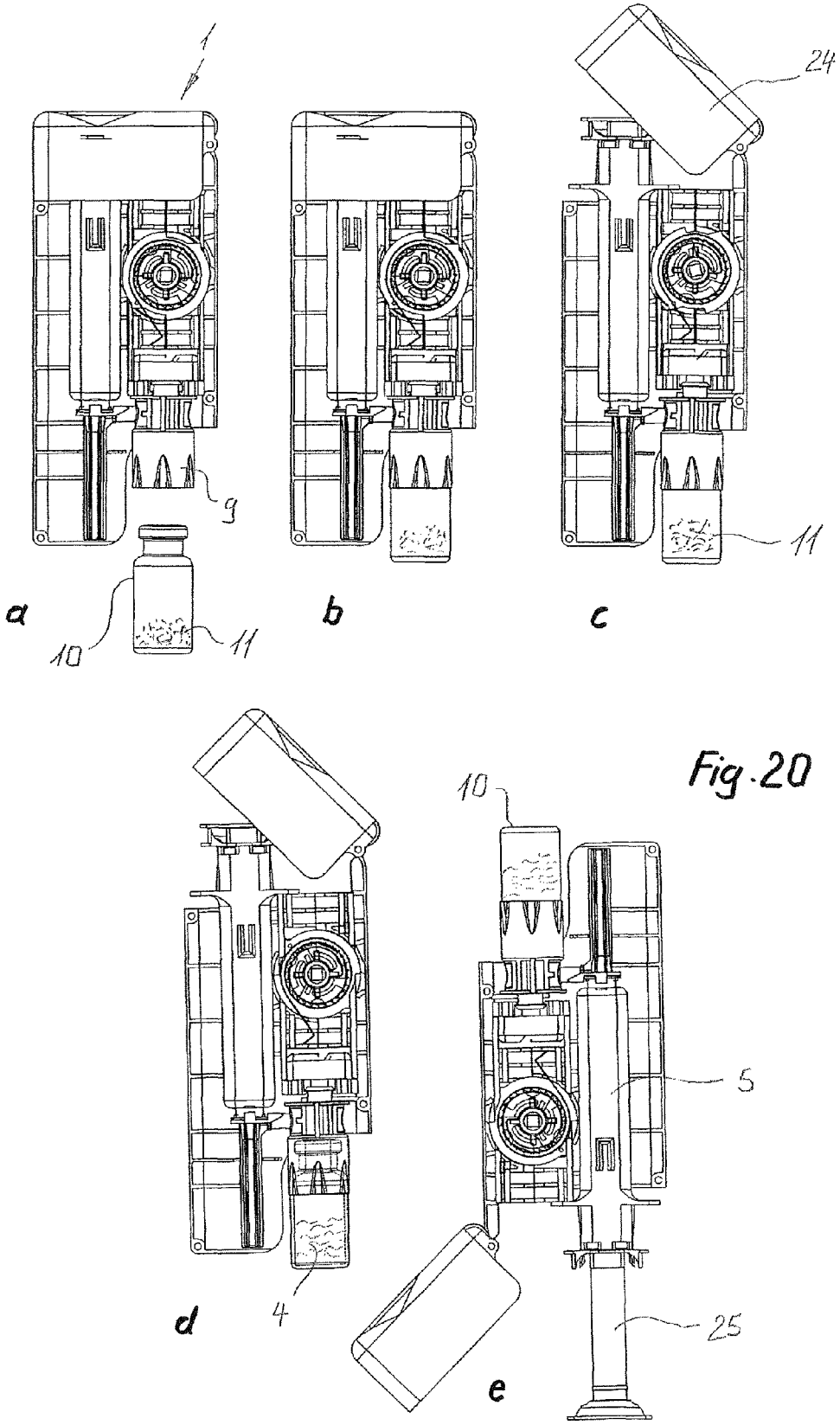

Analogous to FIG. 20, FIG. 27 shows the development of the liquid transfer in the case of the alternative exemplary embodiment. Here too, according to a and b, the container 10 is first of all connected to the connecting piece 9 and the cover 24 is then opened. As a result of this the spring mechanism is activated (c), whereupon the squeezing our operation begins. Once the injection solution has been completely reconstituted in the container 10, the contents thereof can be received into the injection syringe.

FIGS. 28 to 35 show a further exemplary embodiment where a connecting piece 9 for connecting a container is not provided. Instead, an additional container 13 in the form of a further bag is arranged inside the housing approximately at right angles to the first bag between the two pressure plates 7. However, the function of the pressure plate arrangement once the spring mechanism has been triggered is the same as in the case of the first exemplary embodiment, i.e. the pressure plate arrangement with the first bag initially travels as a result of a lifting movement such that the lifting valve 15 (FIGS. 31 and 33) is opened. The liquid then passes via the transfer channel and via a valve device 14 initially into the additional container 13. In this case, this is also a lifting valve analogous to the lifting valve 15 on the first bag. Once the additional container has been filled, as shown in FIG. 34, the prepared injection liquid passes as described above into the injection syringe 5. A second substance, which can be either solid or liquid, can be assigned to the additional container 15.

FIGS. 36 to 50 show an alternative exemplary embodiment of a device where, with the basic principle not changing, the mechanism for pressing the pressure plates together has been severely simplified. Analogous to the exemplary embodiments described previously, the device, designated in general by the reference 1, has a housing 2 with a laterally arranged syringe holder 29 and with a connecting piece 9 for connecting a container (not shown here). The casing 37 for receiving the injection needle can be seen along with the connecting piece (FIG. 36). Recesses 64 are arranged at the side in the housing such that the two pressure plates 63, 63' (FIG. 37) can be seen from the outside. An angled handle element 61 is mounted so as to be pivotable about joint pins 62, the joint pins engaging in corresponding openings in the housing 2. The handle element obviously secures the syringe mounted in the syringe holder 29.

Two spring clamps 60, only one of which can be seen in FIGS. 36, 37 and 38, are provided as a mechanical energy storage device for compressing the flexible bag 3. The ends of said spring clamps rest in angled spring bearings 65 which are arranged on the side of the pressure plates 63 and 63'. Said spring bearings 65 are supported in turn on abutments 66 on the housing 2, said abutments being open to above. In this way, the pressure plates 63 and 63' remain in their tensioned position in which they do not touch the flexible bag 3 (FIGS. 38 and 39).

The two pressure plates are suspended at their top end so as to be laterally displaceable, as can be seen from FIG. 40. For this purpose, the handle element 61 is provided with a continuous eccentric strip 67 which extends between the two joint pins 62. The two pressure plates 63, 63' are suspended on a hook-like suspension 68 on said eccentric strip.

The flexible bag 3 is provided at its bottom end with a bag closure 69, which is a component part of a valve device 12, as can be seen from FIG. 41. In the non-opened state, a dispensing channel between the bag and the connected receptacle is closed. The operating state according to FIG. 4 consequently corresponds substantially to that according to FIG. 13. Consequently, there is no need to describe all the details again.

When the handle element 61 is pivoted up, an operation occurs which is described more precisely by way of FIGS. 42 to 50. According to FIGS. 42 and 43, the two pressure plates 63 and 63' are raised just so far that the two spring bearings 65 are raised beyond the two abutments 66. In said position, the pressure plates are still suspended in the spread position, as can be seen from FIG. 44.

Once the abutments have been left, the two spring clamps 60 are relaxed and the two pressure plates are acted upon by the spring force and pressed against one another. Said situation is shown in FIGS. 45 and 46. FIG. 47 shows how the two pressure plates are guided at their suspension or on the eccentric strip 67. At the bottom end facing the connecting piece 9, the two pressure plates are guided in a transverse guide 70 with a transverse slot. On the bottom surface, the pressure plates have a guide continuation 71 which engages in the transverse slot for this purpose. The transverse guide 70 is connected to the bag connection 69 such that said bag connection is obviously lifted together with the pressure plates.

The raised position can be seen again from FIG. 49, the eccentric strip 67 engaging under the suspension and lifting during the course of the pivoting movement about the joint pins 72. According to FIG. 50, the valve device 12 is moved into an open position as a result of the lifting movement of the bag connection such that the contents of the flexible bag 3 can be squeezed into the container on the connecting piece 9.

The invention claimed is:

1. A device for reconstitution of injection solutions, said device comprising:

a housing, a flexible bag, which is arranged in the housing, for receiving a liquid, a dispensing device which is arranged in the housing and is removable from the housing, a transfer channel for direct or indirect transfer of the liquid from the bag into the dispensing device, and at least one pressure plate, which is pressable against the bag, for squeezing the bag, wherein the housing comprises a connecting piece for connecting a container containing a second substance, and the connecting piece communicates with at least one element of a group consisting of the transfer channel and the flexible bag by a valve device.

2. device for reconstitution of injection solutions, said device comprising:

a housing, a flexible bag, which is arranged in the housing, for receiving a liquid, a dispensing device which is arranged in the housing and is removable from the housing, a transfer channel for direct or indirect transfer of the liquid from the bag into the dispensing device, and at least one pressure plate, which is pressable against the bag, for squeezing the bag, wherein an additional container, which communicates with the transfer channel by a valve device, is arranged in the housing.

3. A device for reconstitution of injection solution, said device comprising:

a housing, a flexible bag, which is arranged in the housing, for receiving liquid, a dispensing device which is arranged in the housing, and is removable from the housing, a transfer channel for direct or indirect transfer of the liquid from the bag into the dispensing device, and at least one pressure plate, which is pressable against the bag, for squeezing out the bag, wherein a valve device, for blocking the fluid connection between the flexible bag and the dispensing device, is arranged in the transfer channel, and the valve device is movable into an open position as a result of a lifting movement.

4. A device for reconstitution of injection solutions, said device comprising:

a housing, a flexible bag, which is arranged in the housing, for receiving liquid, a dispensing device which is arranged in the housing and is removable from the housing, a transfer channel for direct or indirect transfer of the liquid from the bag into the dispensing device, and at least one pressure plate, which is pressable against the bag, for squeezing out the bag, wherein a mechanical energy storage device is arranged as a driving means in the housing by way of which the at least one pressure plate is pressable against the bag and the dispensing device comprises an injection syringe.

5. The device as claimed in claim 4, wherein a spring mechanism with at least one spiral spring is arranged in the housing, and a drive axis of the spring mechanism is connected to a cam disk for converting the rotational movement into at least one linear force component.

6. The device as claimed in claim 5, wherein the at least one pressure plate is mounted in the housing together with the bag and is mounted so as to be linearly displaceable relative to the cam disk, and the cam disk interacts in such a manner with engagement members on the pressure plate that initially the cam disk carries out a liner movement and is then pressed against the bag maintaining a reached end position.

7. The device as claimed in claim 4, wherein the housing comprises a cover or a handle element and the driving means is activatable as a result of opening of the cover or as a result of actuating the handle element.

8. The device as claimed in claim 4, wherein the injection syringe is mounted in a syringe holder in the housing with the piston retracted, and the injection syringe comprises a needle holder with a fill opening which communicates with the transfer channel, and the fill opening is closable when the injection syringe is removed from the syringe holder.

9. The device as claimed in claim 4, wherein the injection syringe contains a second substance.

10. The device as claimed in claim 5, wherein the at least one pressure plate is designed as two pressure plates and the bag is arranged between the two pressure plates, and each of the two pressure plate has a spring mechanism with a cam disk associated therewith.

11. The device as claimed in claim 10, wherein the two cam disks comprise cam portions which are realized differently in such a manner that the two pressure plates are pressable against the bag in a non-symmetrical movement.

12. The device as claimed in claim 4, wherein at least one spring clamp is mounted in the housing in such a manner in a rest position which is tensioned against a spring force of the at least one spring clamp that, as a result of a lifting movement, the at least one spring clamp is movable out of the rest position into a pressing position in which the at least one pressure plate is pressable against the bag.

13. The device as claimed in claim 12, wherein the housing comprises a cover or a handle element, the driving means is activatable as a result of opening of the cover or as a result of actuating the handle element, the at least one pressure plate is displaceable in the housing as a result of opening the cover or as a result of actuating the handle element and by said displacement, the spring clamp is movable into the pressing position and, at the same time, a valve device, which is arranged in the transfer channel, for blocking the fluid connection between the flexible bag and the dispensing device, is movable into an open position.

14. The device as claimed in claim 7, wherein the housing comprises a handle element, the handle element is realized as a lever which is pivotable about a rotary joint and, in a closed position, secures the dispensing device in the housing and, in an open position, releases the dispensing device.

15. The device as claimed in claim 13, wherein the cover or the handle element is operatively connected in such a manner to the at least one pressure plate by a lever gear unit that rotational movement at the cover or at the handle element is transferrable into a linear movement at the at least one pressure plate.

* * * * *